US011365611B2

(12) United States Patent
Gibb

(10) Patent No.: US 11,365,611 B2
(45) Date of Patent: Jun. 21, 2022

(54) METAL SEAL FOR LINER DRILLING

(71) Applicant: CONOCOPHILLIPS COMPANY, Houston, TX (US)

(72) Inventor: John Gibb, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 210 days.

(21) Appl. No.: 15/952,805

(22) Filed: Apr. 13, 2018

(65) Prior Publication Data

US 2018/0313193 A1 Nov. 1, 2018

Related U.S. Application Data

(60) Provisional application No. 62/492,731, filed on May 1, 2017.

(51) Int. Cl.

| | |
|---|---|
| ***E21B 43/10*** | (2006.01) |
| ***E21B 7/20*** | (2006.01) |
| ***E21B 17/04*** | (2006.01) |
| ***E21B 33/12*** | (2006.01) |
| ***E21B 36/00*** | (2006.01) |

(52) U.S. Cl.

CPC ..... *E21B 43/10* (2013.01); *E21B 7/20* (2013.01); *E21B 17/04* (2013.01); *E21B 33/1208* (2013.01); *E21B 36/00* (2013.01)

(58) Field of Classification Search

CPC ..... E21B 17/04; E21B 33/1208; E21B 36/00; E21B 43/10; E21B 7/20

See application file for complete search history.

(56) References Cited

U.S. PATENT DOCUMENTS

| | | | | |
|---|---|---|---|---|
| 6,474,414 | B1 | 11/2002 | Gonzalez et al. | |
| 6,664,522 | B2 | 12/2003 | Spencer | |
| 6,828,531 | B2 | 12/2004 | Spencer | |
| 7,152,657 | B2 | 12/2006 | Bosma et al. | |
| 7,290,609 | B2 | 11/2007 | Wardlaw et al. | |
| 2004/0149443 | A1 | 8/2004 | La Rovere et al. | |
| 2005/0109511 | A1 | 5/2005 | Spencer | |
| 2005/0199307 | A1 | 9/2005 | Eden | |
| 2006/0144591 | A1 | 7/2006 | Gonzalez et al. | |
| 2010/0025113 | A1* | 2/2010 | Warren | E21B 7/20 175/57 |
| 2015/0101813 | A1* | 4/2015 | Zhao | E21B 33/04 166/302 |
| 2015/0368542 | A1* | 12/2015 | Carragher | C22C 12/00 166/288 |
| 2017/0234100 | A1* | 8/2017 | Carragher | E21B 29/10 166/277 |

FOREIGN PATENT DOCUMENTS

| | | |
|---|---|---|
| WO | 20160024122 A2 | 2/2016 |
| WO | 20160024123 A1 | 2/2016 |

OTHER PUBLICATIONS

International Search Report, PCT/US2018/027533 dated Aug. 23, 2018; 4 pgs.

* cited by examiner

*Primary Examiner* — Caroline N Butcher

(74) *Attorney, Agent, or Firm* — Conocophillips Company

(57) ABSTRACT

Systems and methods of forming a seal employ a robust metal sealing unit for tubulars used in rotary drilling. Specifically, eutectic alloy is used to seal a tubular to a wellbore after drilling. A downhole heater melts the alloy, allowing the alloy to expand and drain before it cools and solidifies between the wellbore and tubular, forming a gas tight seal.

12 Claims, 4 Drawing Sheets

METAL SEAL FOR LINER DRILLING

PRIOR RELATED APPLICATIONS

This application is a non-provisional application which claims benefit under 35 USC § 119(e) to U.S. Provisional Application Ser. No. 62/492,731 filed May 1, 2017, entitled "METAL SEAL FOR LINER DRILLING" which is incorporated herein in its entirety.

FIELD OF THE DISCLOSURE

The disclosure relates to rotary drilling used in hydrocarbon reservoirs. In particular, new sealing units for liners and casing strings are disclosed.

BACKGROUND OF THE DISCLOSURE

A hydrocarbon well is typically drilled using a drill bit attached to the lower end of a "drill string." The drill string is a long string of sections of drill pipe, individually called joints, that are connected together end-to-end. Drilling fluid, or mud, is typically pumped down through the drill string to the drill bit to facilitate the drilling. This drilling fluid lubricates and cools the drill bit, and it carries drill cuttings back to the surface in the annulus between the drill string and the borehole wall.

After a predetermined length of borehole is formed, the bit and drill string are removed from the well and a larger diameter tubing—called casing or liner—is inserted to form the wellbore. The process of pulling the drill string out of the well and then going back in is called "tripping." The casing is used to line the borehole walls, and the annular area between the outer surface of the casing and the borehole is filled with cement to help strengthen the wellbore and aid in isolating sections of the wellbore for hydrocarbon production.

Conventional drilling typically includes a series of drilling, tripping, casing and cementing, and then drilling again to deepen the borehole. This process is very time consuming and costly. Additionally, other problems are often encountered when tripping the drill string. For example, the drill string or the drill bit may get caught up or stuck in the borehole while it is being removed. These problems require additional time and expense to correct.

To avoid the time, expense and potential problems of tripping, casing string or liners have been substituted for drill pipe in the drilling string when drilling. However, casing while drilling has only recently become practical because of the development of more robust tools. The main thrust of the work boiled down to solving four considerable challenges: rotating the casing using a top drive system; gripping and supporting the casing string without using its threads; locking a wireline-retrievable drilling assembly to the bottom of the casing; and developing a practical underreamer to open the hole enough to accept the casing string. Once the technical challenges were solved, results from multiple projects have demonstrated time savings up to 26% as compared to conventional drilling and casing operations, with reduced operational and safety risks.

The main purpose of "casing drilling", or "casing while drilling" ("CwD"), is to eliminate classic casing runs and isolate formations while drilling. By using standard casing string instead of conventional drill string, the drilling and casing are executed simultaneously, section by section. However, another advantage of CwD is the "smearing" or "plastering" effect. The larger diameter pipe smears the cuttings and drilling mud into the wellbore wall, sealing it and strengthening and reducing cutting delivery to the surface. This can help prevent and/or cure fluid losses while drilling. A casing diameter/hole diameter ratio of 0.8 and choice of drilling mud helps to maximize the smear effect, and can be very beneficial in lost circulation zones.

There are three main types of CwD, determined by the configuration and operation of the drill:

Non-Retrievable Casing While Drilling System
Retrievable BHA Casing While Drilling System
Drilling with Liner Systems Non-Retrievable Casing While Drilling System: The non-retrievable system is the simplest type of CwD. In this case, the system is made up of a drillable bit or drill shoe, a casing string, and a casing drive system. The drill shoe is fitted securely to the bottom of the casing string; the latter is rotated by a power swivel that is hooked up to the drive system.

Retrievable BHA Casing While Drilling System: The retrievable casing while drilling BHA system strikes a balance between conventional drilling tools and CwD. The main advantage of this system is that it can be steered, and used with both conventional measured while drilling (MWD) and logging while drilling (LWD) tools.

Most BHA systems are connected to the bottom of the casing string, and drill a pilot hole. This hole can then be enlarged using one of three methods: 1) a reaming casing shoe, 2) a near casing shoe underreamer, or 3) a near bit underreamer.

The pilot BHA connects with the main casing, using Drill-Lock-Assembly (DLA) to set in the casing profile nipple (CPN). Once it has reached the total depth (TD), the BHA can then be retrieved using a drill pipe or a wireline; which method is used will depend on the weight and angle of the BHA.

With this system, cementing is usually done after BHA retrieval. Using a pump down float, which is dropped into the casing and pumped to lock in at the CPN, the cementing can be quickly and easily performed normally.

Drilling with Liner Systems: Drilling with Liner (DwL) works in much the same way as the previous two systems, except it does not involve the use of a casing drive system. The liner hanger setting tool is connected to the drill pipe, and then attaches to the power swivel at surface. There are three sub-types of this system: non-retrievable, wireline retrievable and drill pipe retrievable.

Once the drill has reached the TD, the non-retrievable DWL is able to set the liner hanger, and then complete the cementing job. With a retrievable DWL, the BHA needs to be retrieved once the liner hanger has been set, before a liner wiper plug latching system or cement retainers are run with the liner top packer and seal assembly to set in the polished bore receptacle (PBR) atop of liner. When the seal assembly is attached to the liner, the cementing can then be carried out normally.

The use of casing string or liners for drilling is an emerging technology that can reduce well-construction costs, improve operational efficiency and safety, and minimize environmental impact. However, further improvements are needed. Even incremental improvements in technology can mean the difference between cost effective drilling and reserves that are unable to recover the economic costs of production.

SUMMARY OF THE DISCLOSURE

Disclosed herein is a seal for a liner or casing string used in rotary drilling and methods of installation. The seal is particular useful in various casing drilling or liner drilling methods. However, the seal can be used on any liner or casing regardless of how the well is drilled.

The use of casing or liner tubulars for drilling is an emerging technology. This drilling technique replaces conventional drill pipe with the large-diameter tubulars that will be permanently installed in a wellbore. The economic demands of complex geologic settings, smaller reservoirs with limited recoverable reserves, and the need to optimize development and exploitation of mature fields make drilling operations with liners or casing increasingly attractive to operating companies.

A sealing unit or bushing is placed on both liner and/or casing strings before deployment. This sealing unit, which is typically made of rubber, allows for the eventually sealing of the area directly above the liner (liner lap) or casing string during the permanent installation phase.

Unfortunately, the seal is prone to damage. It can be damaged on the trip into the hole or in response to the high-pressure environment. Alternatively, as it is necessary to rotate the liner or casing string over long periods of time, the seal's rubber surface continually contacts the metal surface of the outer casing and wears the rubber out. The only option to cure these issues is to shut down the drilling, pull the damaged tubular and replace the seal. This is a costly and time-consuming process.

The presently disclosed seal addresses these issues with rubber seals by using a bismuth-based alloy sealing unit on the outside of the tubular. The advantage of this sealing unit is that the bismuth is smaller in diameter than the rubber seal, thus it does not touch or contact the outer casing during liner or casing string rotation. Further, to create the seal, a heater can be run into the well to melt the alloy and allow it to flow outward to form a VO gas tight seal.

Alternatively, the bismuth-based alloy sealing unit can be used as a backup to the rubber seal, wherein backup option is only used when/if the rubber seal be damaged.

Use of the alloy sealing unit creates a more robust drilling tubular. This in turn reduces the cost of drilling because it is less likely to be damaged and require removal, smaller crews sizes can be used, and the overall time for drilling is reduced.

The alloy can be heated by a downhole tool comprising at least one heating element. The heated, molten alloy will then flow into the annulus between the liner/casing string and the outer casing. Exemplary heating tools are described in WO2016024123.

Exemplary bismuth-based alloys are described in U.S. Pat. No. 7,290,609. As a general rule, bismuth alloys of approximately 50% bismuth exhibit little change of volume (1%) during solidification. Alloys containing more than this tend to expand during solidification and those containing less tend to shrink during solidification. Additional alloys are described in US20150368542, which describes a bismuth alloy comprises bismuth and germanium and/or copper. Preferably, the bismuth-based alloy is eutectic. Additional eutectic alloys to plug wells or repair existing plugs in wells are described in U.S. Pat. No. 7,152,657; US20060144591; U.S. Pat. Nos. 6,828,531; 6,664,522; 6,474,414; and US20050109511.

The bismuth-based alloy may be at least 5-20 feet in length pre-installation. Preferably, the alloy is 5-15 feet in length and most preferably, the alloy is 10 feet in length. Ideally, the alloy layer is at least half of an inch in thickness. However, this can be increased depending on the thickness of the annulus between the outer casing string and the liner or casing string used in the rotary drilling.

In some embodiments, the liner or casing string itself be manufactured to have a "shelf" on the outer surface to hold the alloy. This shelf can be formed by using two different outer diameters of the casing or liner, wherein the smaller outer diameter occurs where the alloy will sit, followed by an abrupt change to the larger outer diameter below the alloy. The advantage of using this 'shelf' is that it can also act as a cool area to slow the flow of the heated alloy so that it is not lost down the well, but instead cools in the target region. However, the shelf or other cooling protrusion is optional.

In other embodiments, the alloy is layered on the outside of the tubular. Preferably, this alloy layer has at least one-inch clearance from the outer casing. However, different numbers of layers or thickness can be used on different sections of the tubular. For instance, the top half of the alloy covered section can be thicker, i.e. have more layers, than the bottom half of the alloy covered section. In such an embodiment, a heater can be used to heat the top half of the alloy and the bottom half can help to cool the draining molten top half.

Alternatively, the 'shelf' or a simple protrusion or a swellable protrusion on the casing or liner can be used as a cool area to slow the heated molten alloy. The swellable protrusion is ideally an intumescent coating, which will expand when exposed to heat from the heating tool and/or initial contact with the heated alloy. Examples of intumescent coatings which are ammonium phosphate, vermiculite, casein, starch, African Isano oil, carbamic phosphoric acid, urea, methylene disalicyclic acid, graphite filled elastomeric compounds and the like. As with the alloy, at least one-inch clearance from the outer casing is necessary for the protrusions during process. Note, the intumescent material is not expected to have the at least one-inch clearance from the outer casing once it is activated during the installation process.

The alloy is placed at the top end (closest to the wellbore opening) of the tubular just like the rubber based sealing units. This placement prevents interference with the ability to connect bottom hole assembly (BHA) units to the tubular. Further, any type of drilling assembly can be used with the described tubulars as the choice of drilling assembly usually depends on the application and available hardware. Non-retrievable drill assemblies are the simplest and more commonly used assembly. Retrievable bottom hole assemblies can perform directional and straight hole drilling and are increasing in popularity. Braided cable is often used to retrieve these assemblies.

In some embodiments, the BHA is short so that it does not stick out below the casing or liner. Further, the BHA can be fully wired, including sensors close to a drilling bit, so that all tools therein communicate with a measurement while drilling tool. This allows for reduced vibration, increased hole quality, and increased smear effect during drilling.

The heater used to melt the alloy can be any known in the art. It can also be retrievable or allowed to remain in the wellbore. Preferably, the heater is run on standard wireline, slick line or coil tubing. In some embodiments, the heater is electric and controlled on the surface. In other embodiments, the heater is a chemical reaction heater that uses materials such as thermite to generate heat. Such heater may provide a one-time use and be left in the well or, may be retrieved and refilled to heat the seals on additional liners.

In some embodiments, the alloy sealing unit is a secondary or backup sealing unit to the traditional rubber-based sealing unit. Here, the alloy layer can either be placed below the rubber sealing unit and/or partially under the rubber sealing unit if space is an issue.

Preferably, the inventive seal is used for liners. DwL operations can be problematic because of the smaller diameters of the liners and torque issues. Thus, the rubber seals are frequently damaged. However, seals on casings used in casing while drilling operations can also be switched out for the alloy-based seals, too.

In use, the liner containing the inventive seal would be used for DwL operations. Once the liner is in position at a predetermined location, it can be hung using normal methods. This hanging may involve the use of slips or an expandable device on the liner. Further, the cementing process can proceed as usual.

This summary is provided to introduce a selection of concepts that are further described below in the detailed description. This summary is not intended to identify key or essential features of the claimed subject matter, nor is it intended to be used as an aid in limiting the scope of the claimed subject matter.

As used herein, "liner lap" means the spacing between the top of the liner and the hanger, or casing shoe of the previous liner.

"Tubulars" is used herein as a generic term pertaining to oilfield casing, liners and the like that are capable of replacing drill pipe used in rotary drilling. The 'top' of the tubular is the end that is closest to the opening of the well and the 'bottom' is closest to the reservoir bottom.

As used herein, "casing" is the large-diameter pipe (e.g., >7") lowered into an openhole and cemented in place. Casing is designed to withstand a variety of forces, such as collapse, burst, and tensile failure, as well as chemically aggressive brines. Most casing joints are fabricated with male threads on each end, and short-length casing couplings with female threads are used to join the individual joints of casing together, or joints of casing may be fabricated with male threads on one end and female threads on the other.

As used herein, a "liner" is a casing string that does not extend to the top of the wellbore, but instead is anchored or suspended from inside the bottom of the previous casing string.

As used herein, "drill pipe, or "drill tubing" is a smaller diameter tubing, usually 2-4" diameter, but can go up to 6⅝". It is a tubular steel conduit fitted with special threaded ends called tool joints. The drillpipe connects the rig surface equipment with the bottomhole assembly and the bit, both to pump drilling fluid to the bit and to be able to raise, lower and rotate the bottomhole assembly and bit.

As used herein, "casing while drilling" refers to the use of casing to lower the drill bit, thus avoiding the tripping needed to pull regular drill string and case the well. Sometimes called drilling with casing or "DwC."

As used herein, "drilling assembly" refers to the lower portion of the drillstring between the drill tubular and bit. The assembly can consist of drill collars, subs such as stabilizers, reamers, shocks, hole-openers, a mud motor (in certain cases), the bit sub and bit, and crossovers for various threadforms. The assembly can either be retrievable or non-retrievable.

The "bottom hole assembly" is a type of drilling assembly that extends from the bit to the casing, liner or other tubular that replaces the traditional drill pipe and is often retrievable using an e.g. braided cable.

As used herein, "sealing unit" refers to a component attached at the top of the drilling tubular (casing, liner, etc) that is used to seal the drilling tubular to the outer casing string or wellbore during installation.

As used herein, "tripping" refers to pulling the drill string out of or running the drill string into the hole.

As used herein, "drill string" refers loosely to the assembled collection of the tubular used from drilling, drill collars, tools, bottom hole assembly, and drill bit. The clarify the difference between the use of regular drill string and casing, we will use the term "casing drill string" instead of drill string.

As used herein, "airtight seal" or "VO gas tight seal" are used interchangeable to refer to the seal formed during the installation process. The seal prevents gases from escaping the reservoir through the annulus between the wellbore and casing or liner. Thus, all gases and liquids are diverted through the center of the piping.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| BHA | bottom hole assembly |
| TD | Total depth |
| DwC | Drilling while casing |
| CwD | Casing while drilling |

DESCRIPTION OF EMBODIMENTS OF THE DISCLOSURE

Figure 1A:
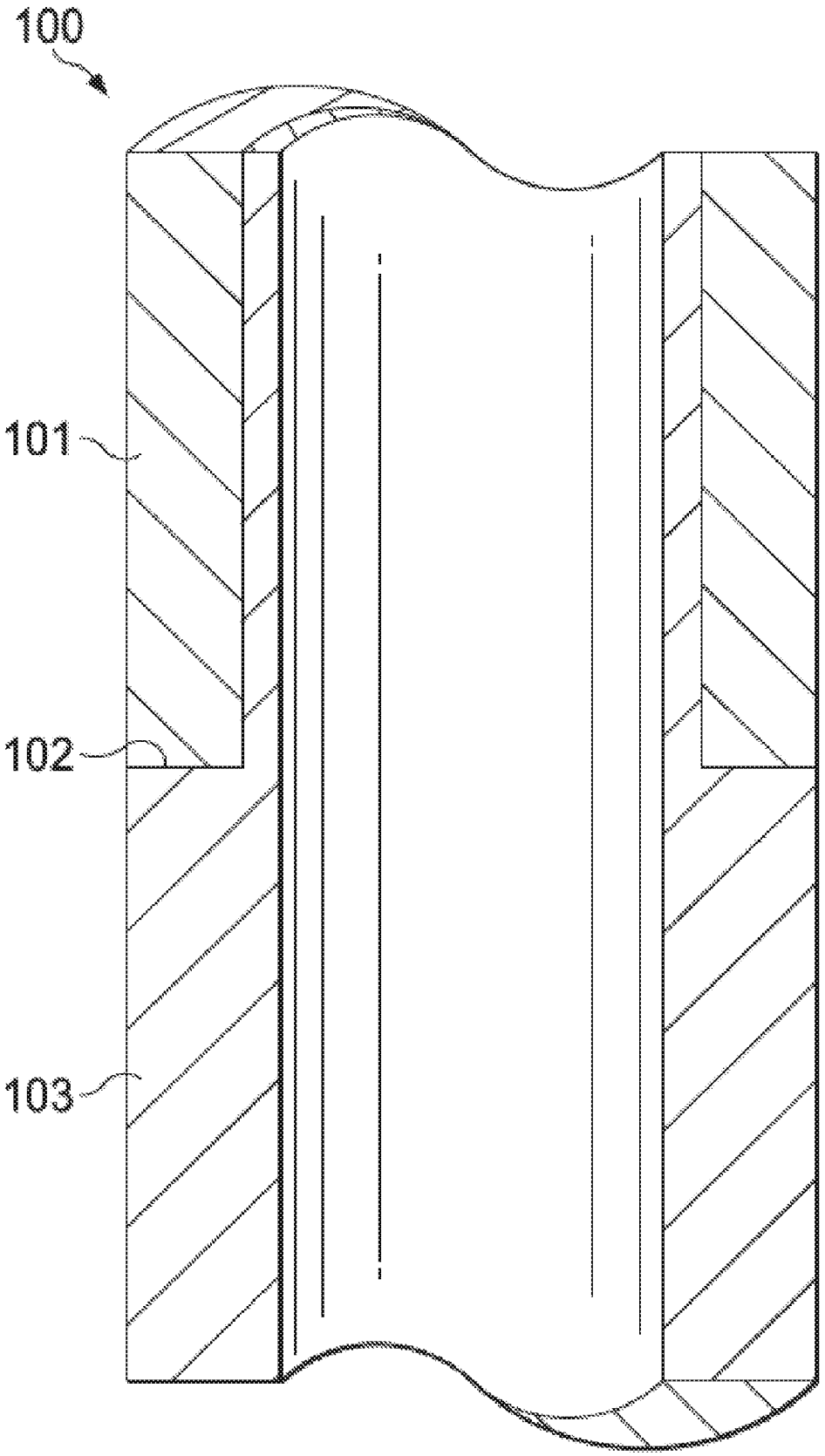
FIG. 1A shows a sealing material disposed in a recess of a tubular according to one embodiment.

The invention provides a novel sealing unit for liner or casing drill strings used in casing while drilling.

The present methods includes any of the following embodiments in any combination(s) of one or more thereof:

An improved tubular used in rotary drilling with a tubular that has a rubber sealing unit at a first end and a drilling assembly at a second end, and the improvement is a layer of eutectic alloy with a known melting point around the outer surface of the first end of the tubular, one or more protrusions on the outer surface of the tubular below the layer of eutectic alloy. The rubber sealing unit can be optional.

A method of forming a seal between an inner and outer tubular string, wherein a tubular with an outer layer of eutectic alloy is placed inside the outer tubular at a first depth and a downhole heater is run into the wellbore until the heater is level with the layer of alloy. The downhole heater heats the layer of alloy to a known melting point to form a molten alloy, wherein the molten alloy falls via gravity before being 'caught' or stopped by one or more protrusions, wherein the protrusion are at a lower temperature than the molten alloy, which allows the molten alloy to cool. After the solidifying molten alloy on the one or more protrusions forms a seal between the tubular and the outer tubular, the downhole heater is removed.

A method for drilling and lining a wellbore wherein a drilling assembly is attached to a tubular that has a eutectic alloy layer with a known melting point around the outer surface of the top of the tubular and a protrusion around the outer surface of the middle of the tubular. The eutectic alloy layer and protrusion have the same outer diameter for a uniform circumferential profile. The tubular does not have a rubber sealing unit. The tubular is used to drill a wellbore to a first depth with the attached drilling assembly before the tubular is attached to an outer tubular with a hanger. This hanger can be any known in the art, such as an inflatable hanger. Once the tubular is attached, drilling assembly can be pulled from the well and a downhole heater can be run into the wellbore until the heater is even with the top of the tubular. The eutectic alloy layer is heated by the downhole heater at a known melting point of eutectic alloy layer, thus melting the eutectic alloy layer to form a molten alloy in the annulus around the tubular. The molten alloy is able to solidify on the protrusion, wherein the solidified alloy forms an airtight seal in the annulus space between the tubular and the outer tubular or surrounding wellbore. The downhole heater can then be pulled from the wellbore after the seal is formed.

In any of the above embodiments, the rubber sealing unit can be optional. In some embodiments, the annular ring replaces the rubber seal. In others, both the annular ring and rubber sealing unit are used together.

Any of the above embodiments can include another step for producing hydrocarbons through the tubular in the wellbore.

In any of the above embodiments, the eutectic alloy can have bismuth. In some embodiments, the alloy has bismuth and germanium or copper or aluminum.

In any of the above embodiments, the drilling assembly can be a retrievable bottom hole assembly or it can be a non-retrievable drill bit.

In any of the above embodiments, the protrusions are intumescent material that expands when heated. Alternatively, the protrusions are metal shelves. The eutectic alloy can be in physical contact with the top of said one or more protrusions.

The main purpose of using casing or liners as the drilling unit is to eliminate classic casing runs and isolate formations while drilling. By using a casing string instead of conventional drill string with drill pipe, the drilling and casing or lining processes are executed simultaneously, section by section. The benefit of combining the process is the maximized efficiency. Two operations are being performed at one time; and, there is a reduction in time for tripping in and out of the well, and the risk involved with it. Once the predetermined well length is drilled and cased or lined, the borehole is ready for cementing, and no additional trips need be made.

Because the casing is being conveyed with the drill pipe or used as the drill pipe in the casing string, it is subject to excessive rotations during the drilling process. This has lead to material breakdowns and damage to the traditional rubber sealing unit used on casings as it hits and rotates against the outer wellbore and casing. Whenever the rubber sealing unit is damaged, the drilling is stopped, the drill string is removed, and the damaged sealing unit is replaced. This process is not only costly and time consuming, but requires the use of more manpower and equipment.

To overcome this issue, an improved and more robust sealing unit has been developed. This sealing unit utilizes an alloy metal that may be thinner than the traditional rubber sealing unit. Thus, it may not contact the outer casing and may not subject to the wear and tear experienced by the rubber.

This robust and novel sealing unit can be layered onto any tubular normally used in rotary drilling, including casings and liners. Or, specially made tubulars with built in indentions for the alloy can be manufactured.

The present invention is exemplified with respect to casings. However, this is exemplary only, and the invention can be broadly applied to liners or any tubulars used in a wellbore. However, its main advantage lies in casing while drilling, and avoiding trips necessitated by sealing failures.

The following examples are intended to be illustrative only, and not unduly limit the scope of the appended claims.

Figure 1B:
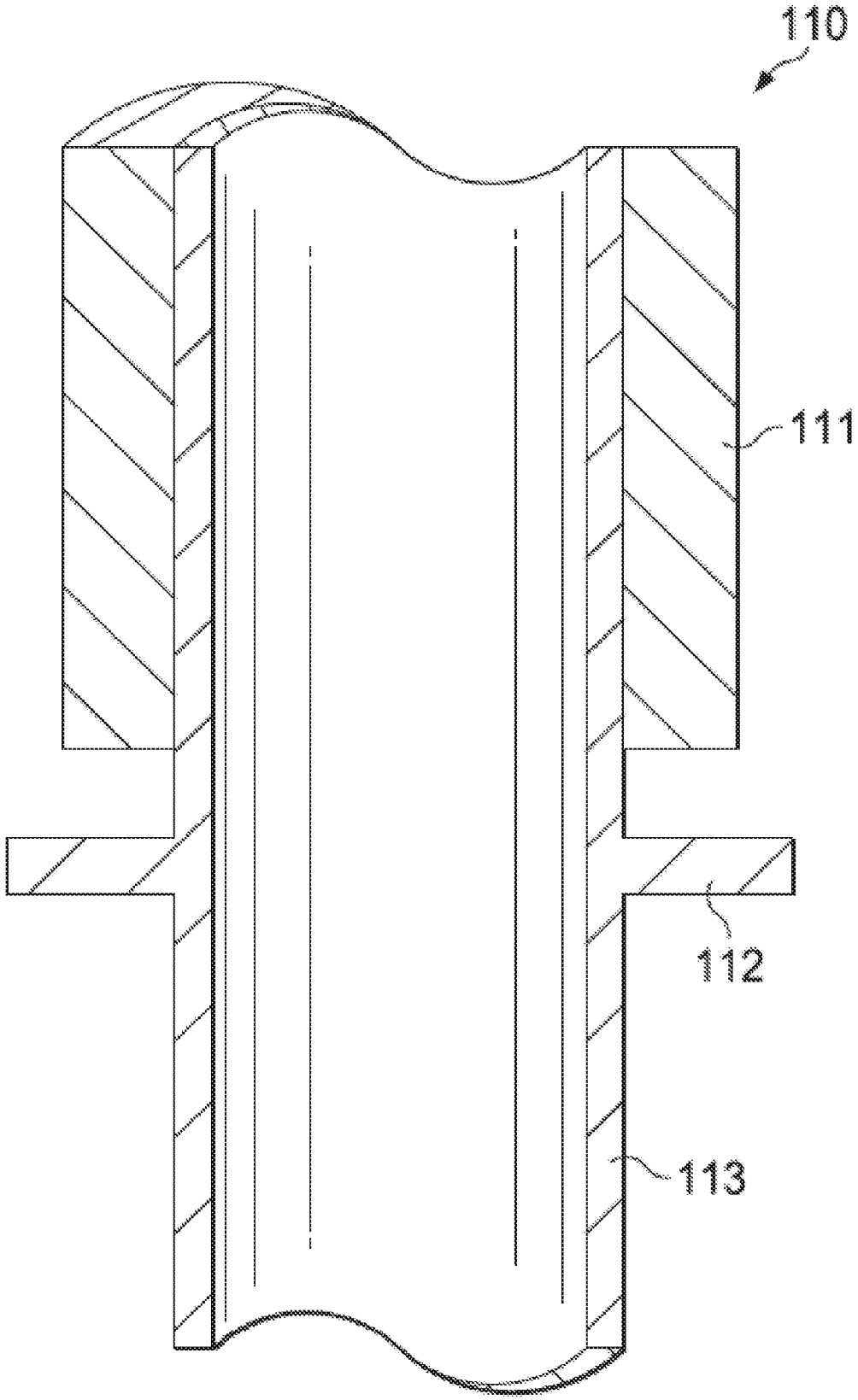
FIG. 1B shows a sealing material disposed above a protrusion according to one embodiment.

FIG. 1A-B depicts two different embodiments of a pre-installation casing according to the present disclosure. In FIG. 1A, the pre-installation casing system 100 has a layer of bismuth-based alloy 101 layered around a casing 103 and sitting on a shelf or collar 102. Increasing the outer diameter of the casing 103 forms the annular shelf.

The benefit of not extending the layer of alloy 101 beyond the width of the casing is to protect the alloy. During the drilling process, the alloy does not contact or rub against any outer casing string or the wellbore wall itself. Once the casing is placed at its predetermined location, a heating tool can be run into the wellbore and used to heat the alloy. Due to gravity, the molten alloy melts and moves downward, yet still spreads horizontally. The shelf 102 can act as a cool zone that slows down the flow of the molten alloy when it is heated. This allows for the alloy to solidify at the same level at this increase in tubular diameter, instead of continuing to flow downward along the casing.

FIG. 1B depicts a variation of a casing system 110 that layers the alloy 111 around the casing 113 but is not supported by a shelf. In this variation, a protrusion 112 acts as a cool zone. This protrusion can be a simple metal ring that is formed on the casing during manufacturing or a swellable protrusion. The benefit of using a swellable protrusion is that it will have a low profile on the casing during the drilling process. However, once heated by the downhole tool, or once it contacts molten alloy, the protrusion swells and acts as a cool area for the molten alloy.

In use, the casings in FIG. 1A-B can be used in a casing while drilling application. The casing replaces or runs in with the drill pipe component of the drill string. A bottom hole assembly, complete with drill bits, can be attached to the casings at the end opposite of the alloy, and this assembly and casing can be rotated as needed without damaging the alloy or the ability to seal the casing later.

Because the alloy layer is on the outer surface of the tubular, it does not affect the rotary drilling operation. Rather, the conventional steps of adding a drilling unit, drilling the wellbore to a predetermined depth using the tubular, and hanging the tubular occur per established procedures. The only deviation comes from the sealing steps during the installation process.

Figure 2:
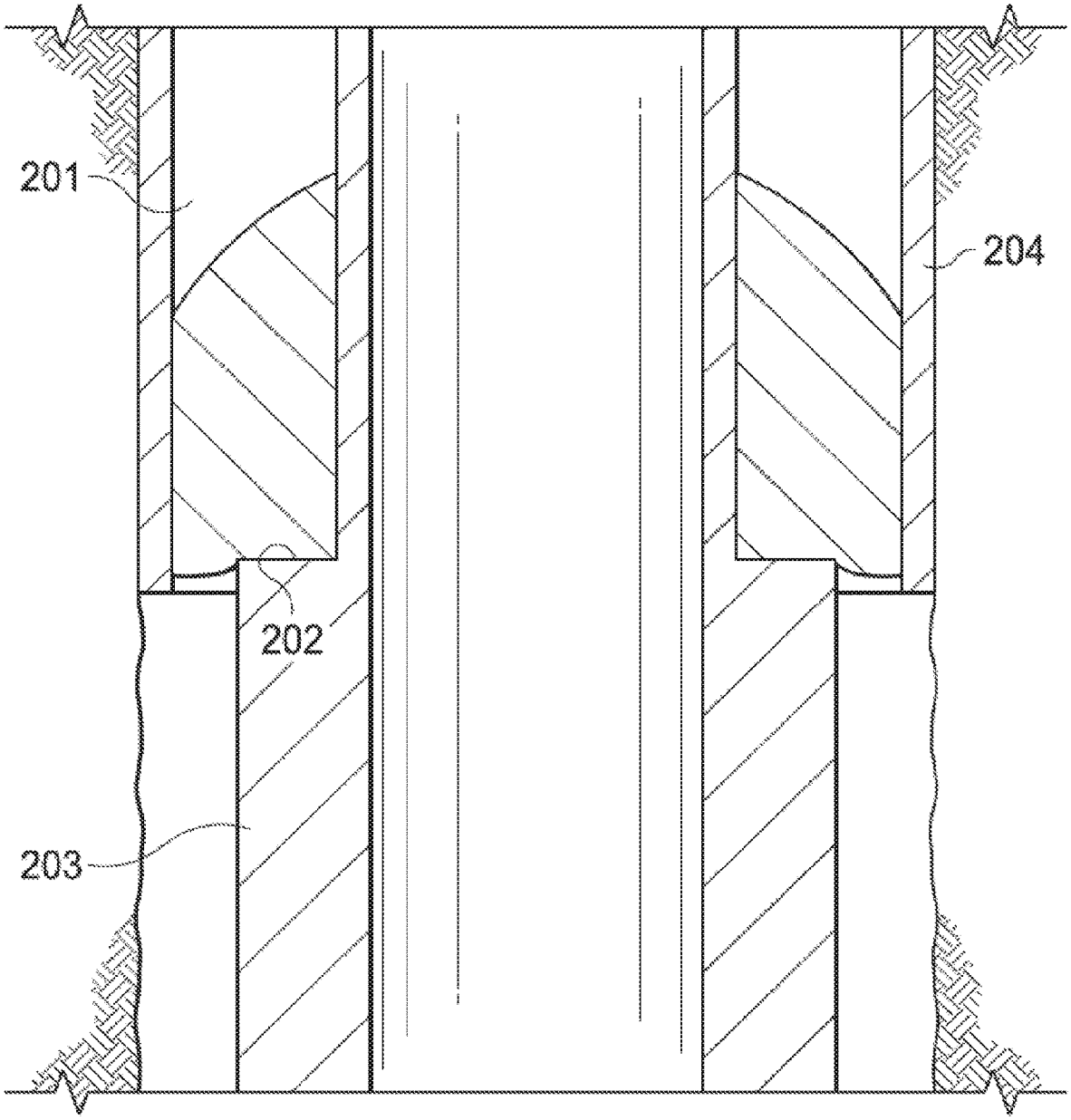
FIG. 2 shows a cross-section of a liner permanently sealed to a wellbore using the present invention.

In FIG. 2, the presently described casing 203 is shown installed in the wellbore and forming a seal with an outer casing 204. The installation will occur once the drilling of a given section is complete. After the drilling bits and bottom hole assembly are removed, a downhole heater can be run into the wellbore, using a wireline, to a depth that is typically at the top of the casing, near the liner lap. The heater can then melt the alloy layered around the top of the casing, allowing this molten alloy to flow downward and outward, forming a tight seal.

The shelf 202 of the casing acts as a cool spot, which prevents the alloy from gravity draining further down the casing. Once completely cooled, the alloy forms a seal in the annulus 201 between the casing 203 and outer casing 204. Variations of alloy thickness can be used to ensure the entire annulus is sealed off. For some embodiments, the outer diameter of the alloy increases along a downward length of the casing prior to the melting providing the alloy with a conical wedge shape. Applying heat to only an upper portion of where the alloy is disposed around the casing thereby causes outward flowing of the melted alloy down the sloping of a lower section of the wedge functioning as a cool zone alone without a further protrusion or shoulder.

One added benefit of the present sealing unit is the ability to re-heat the alloy to reset sealing, remove it, reposition it, or to allow for repositioning of the tubular without having to pull the tubular to add a new seal. For instance, multiple protrusions can be used along the length of the tubular to allow for the seal to be repeatedly heated, flowed further downward, and solidified on the next protrusion.

Figure 3:
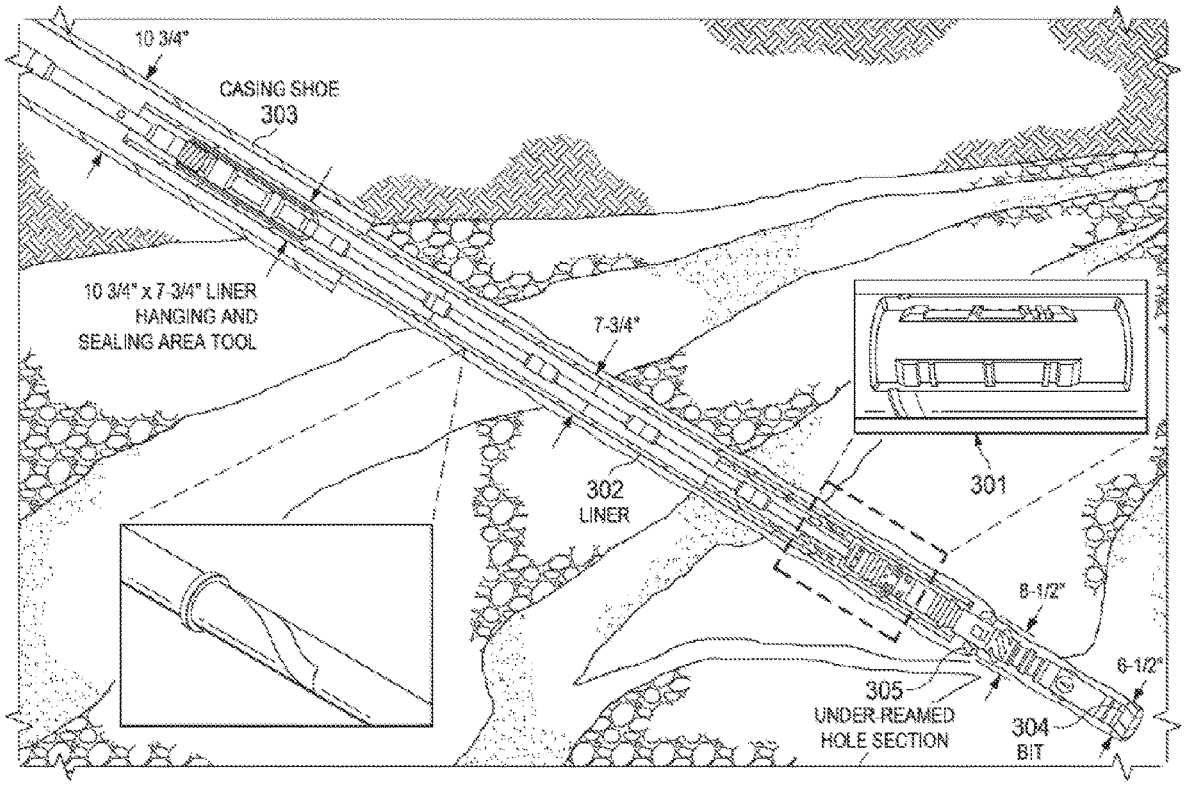
FIG. 3 shows an exemplary liner while drilling setup wherein a liner that is smaller in diameter than a casing is attached to a drilling unit and used to drill a wellbore.

Before or after the metal seal is formed, the liner can be cemented into place. FIG. 3 displays an exemplary BHA unit 301 attached to a liner 302 for drilling and sample diameters of each segment of the assembly. The BHA includes a drill bit 304 and a reamer 305, both of which are located at the distal end of the liner 302. The liner 302 is inside of a casing 303 and will be hung therefrom, typically using slips or an expandable device. The BHA assembly can be removed after hanging the liner or it may remain in the well.

Once hung, a heater can be run into the wellbore for heating the alloy layer and forming a metal seal between the liner and casing shoe, in the liner lap. Once positioned at desired depth, cement can be added per normal procedures. In some embodiments, the cement is pumped through the liner and allowed to circulate into the annulus between the liner and borehole, below location for the metal seal.

While some of the above embodiments are described using an inner casing for the drilling and the alloy seal forming between the inner casing and an outer casing, it is also possible for the seal to form between the casing used for drilling and the wellbore.

The invention claimed is:

1. A method of drilling and lining a wellbore, comprising:

during a drilling while casing operation (DWC) attaching a drilling assembly to a tubular, wherein said tubular has a eutectic alloy layer around an outer surface of a top of the tubular said outer diameter of the alloy increases along a downward length of the casing providing the alloy with a conical wedge shape, said eutectic alloy layer disposed partially under a rubber sealing unit and above an intumescent coating that expands when heated;

drilling a length of the wellbore using said tubular with the drilling assembly;

attaching with a hanger said tubular to a surrounding tubing string disposed in the wellbore;

operating a downhole heater disposed even with the top intumescent coating thereby expanding said intumescent coating to form a seal between said tubular and the surrounding tubing string;

removing the downhole heater while melting said eutectic alloy layer to form a molten alloy in an annulus around said tubular and said rubber sealing unit; and solidifying said molten alloy, wherein said solidified alloy forms an airtight seal in an annular space between said tubular and an outer tubing string disposed in the wellbore thereby creating a VO gas tight seal.

2. The method of claim 1, further comprising pulling said drilling assembly from the wellbore.

3. The method of claim 1, further comprising producing hydrocarbons from said wellbore.

4. The method of claim 1, wherein said attaching step uses an expandable hanger.

5. The method of claim 1, wherein said eutectic alloy comprises bismuth.

6. The method of claim 1, wherein said eutectic alloy comprises bismuth and germanium, copper, or aluminum.

7. A system for use in rotary drilling, comprising:

a drilling while casing (DWC) tubular with a layer of eutectic alloy around an outer surface of a first end of the tubular said outer diameter of the alloy increasing along a downward length of the casing providing the alloy with a conical wedge shape said eutectic alloy layer disposed partially under a rubber sealing unit;

one or more protrusions on the outer surface of the tubular and below the layer of eutectic alloy wherein said one or more protrusions are intumescent material that expands when heated; and a drilling assembly at a second end of the tubular.

8. The system of claim 7, wherein said eutectic alloy comprises bismuth.

9. The system of claim 7, wherein said eutectic alloy comprises bismuth and germanium, copper, or aluminum.

10. The system of claim 7, wherein said drilling assembly is a retrievable bottom hole assembly.

11. The system of claim 7, wherein said eutectic alloy is in physical contact with the top of said one or more protrusions.

12. A method of forming a seal between inner and outer tubular strings, comprising drilling a wellbore during a drilling while casing operation (DWC) using the inner tubular string having a layer of eutectic alloy said outer diameter of the alloy increases along a downward length of the casing providing the alloy with a conical wedge shape, wherein said inner tubular string is inside the outer tubular string and said eutectic alloy layer disposed partially under a rubber sealing unit and above one or more protrusions of an intumescent material that expands when heated;

running a downhole heater into the wellbore until said heater is level with said intumescent material;

heating the intumescent material to form a seal;

heating the layer of eutectic alloy to form a molten alloy;

catching the molten alloy falling via gravity with one or more protrusions;

solidifying said molten alloy on said one or more protrusions to form an airtight seal between said inner tubular string and said outer tubular string; and removing said downhole heater thereby creating a VO gas tight seal.

* * * * *